United States Patent [19]

Herzenberger

[11] Patent Number: 4,643,425

[45] Date of Patent: Feb. 17, 1987

[54] MICROPROCESSOR CONTROLLED ROULETTE GAME INCLUDING AN OPTICAL ENCODER FOR SENSING THE POSITION OF THE BALL ON THE ROULETTE WHEEL

[76] Inventor: Mario Herzenberger, Via Don Sturzo, 2, 21028 - Travedona Monate (Varese), Italy

[21] Appl. No.: 665,062

[22] Filed: Oct. 26, 1984

[30] Foreign Application Priority Data

May 2, 1984 [IT] Italy ..... 20767 A/84

[51] Int. Cl.[4] ..... A63F 5/00

[52] U.S. Cl. ..... 273/142 B; 273/138 A; 273/142 JD

[58] Field of Search ..... 273/119 A, 122 A, 123, 273/138 A, 125 A, 142 A, 142 R, 142 B, 142 C, 273/142 D, 142 E, 142 F, 142 G, 142 HA, 142 J, 273/142 JA, 182 R; 901/40; 364/410–412

[56] References Cited

U.S. PATENT DOCUMENTS 4,269,413 5/1981 Langieri ..... 273/125 A 4,287,459 9/1981 Dahlstrom ..... 901/40

4,396,193 8/1983 Reinhardt et al. ..... 273/142 B 4,430,903 2/1984 Hooker et al. ..... 273/143 R

FOREIGN PATENT DOCUMENTS 1451032 9/1976 United Kingdom ..... 273/142 D

*Primary Examiner*—Richard C. Pinkham

*Assistant Examiner*—MaryAnn Stoll Lastova

*Attorney, Agent, or Firm*—Bucknam and Archer

[57] ABSTRACT

The electronic roulette comprises, in a box-like body, a roulette wheel, including a plurality of numbered sectors, an electric motor for driving it, launching assembly to be operated by the player to launch a ball into the roulette wheel, a playing selecting keyboard to be actuated by the player for defining the stake value, and a ball position sensing optical encoder for sensing the position of the ball on the roulette wheel, an inlet channel for introducing tokens in order to set the stake value, a token supplying hopper for supplying a predetermined number of tokens in the case of a win by the player, and a microprocessor circuit operatively coupled to all of the mentioned elements to control them.

1 Claim, 7 Drawing Figures

MICROPROCESSOR CONTROLLED ROULETTE GAME INCLUDING AN OPTICAL ENCODER FOR SENSING THE POSITION OF THE BALL ON THE ROULETTE WHEEL

BACKGROUND OF THE INVENTION

The present invention relates to an electronic roulette particularly designed for playing purposes in amusement fairs, bars, playing rooms, casino's and the like.

Electronic roulette devices are already known in particular those included in the so-called video-game class, provided for simulating a real roulette by means of dedicated electronic circuits.

Usually, in the mentioned known electronic roulette devices, the ball and the movement thereof are simulated by light displays, and the result of the playing is of a fictitious type, that is it consists of a display on a screen, usually of the CRT type, or of any other suitable types, as in the broadly diffused electronic games.

Among the presently available electronic games the roulettes have had a scarce success, because of the fact that they lack of the fascination of a real roulette, mainly due to two main factors, that is that of an actual win and that of playing participation, that is the possibility of launching a real ball and oberving the latter both during the launching operation and as it is in a rest condition, on the numbered or patterned sectors of the roulette wheel.

Infact, as aforesaid, in the known electronic roulettes, the ball is a fictitious one and it is launched, also in a fictitious way by the player by pushing keys or push-buttons and, at the end of the launching operation, the player will see a light spot associated with a number or a colour or different combination.

In actual practice the player, lacking of any possibilities of directly controlling the ball movement, feels himself as cheated by the apparatus which, in addition, can not supply remunerations.

SUMMARY OF THE INVENTION

Accordingly, in the light of the above mentioned and other drawbacks of the known electronic roulettes, the main object of the present invention is to provide such an electronic roulette structure therein is held unchanged the fascination of the real play while affording the player the possibility of actively participating, by launching a real ball and with the possibility of directly observing its movement as well as the precise physical pattern or number thereat the ball will stop in order to compare the fitting to the stake.

Another object of the present invention is to provide such an electronic roulette which, as desired, may supply the players with remunerations, in the form of selling tokens or the like, in the case of a win by the player, with a procedure and values analogous to those of a real roulette.

Another object of the present invention is that of providing such an electronic roulette which is a very flexible one, that is susceptible to be easily fitted to the use in fairs, playing rooms, bars, casinos and the like depending on the regulamentations which are to be applied.

Yet another object of the present invention is to provide such an electronic roulette which includes means effective to be directly controlled by the player to affect, if desired, the movement of the roulette wheel, in such a way as to play a real ability play.

Yet another object of the present invention is to provide an electronic roulette including a ball position sensing device which is very reliable, that is effective to provide, in any conditions, a precise information relating to the position of the ball, as the latter stops in a numbered sector or pattern of the roulette wheel.

Yet another object of the present invention is to provide such an electronic roulette the controlling software whereof is specifically designed to prevent any malfunctions or tamperings from occurring.

Yet another object of the present invention is to provide such an electronic roulette comprising a microprocessor central controlling unit (CPU) effective to control all of the functions of the apparatus, as well as possible acoustic signals associated with the machine itself.

According to one aspect of the present invention the above mentioned objects, as well as yet other objects which will become more apparent thereinafter are achieved by an electronic roulette, according to the accompanying claim.

BRIEF DESCRIPTION OF THE DRAWINGS

Further characteristics and advantages of the electronic roulette according to the present invention will become more apparent from the following detailed description of preferred embodiments whereof, which are illustrated, by way of indicative but not limitative examples, in the accompanying drawings, where.

DESCRIPTION OF THE PREFERRED EMBODIMENTS

Figure 1:
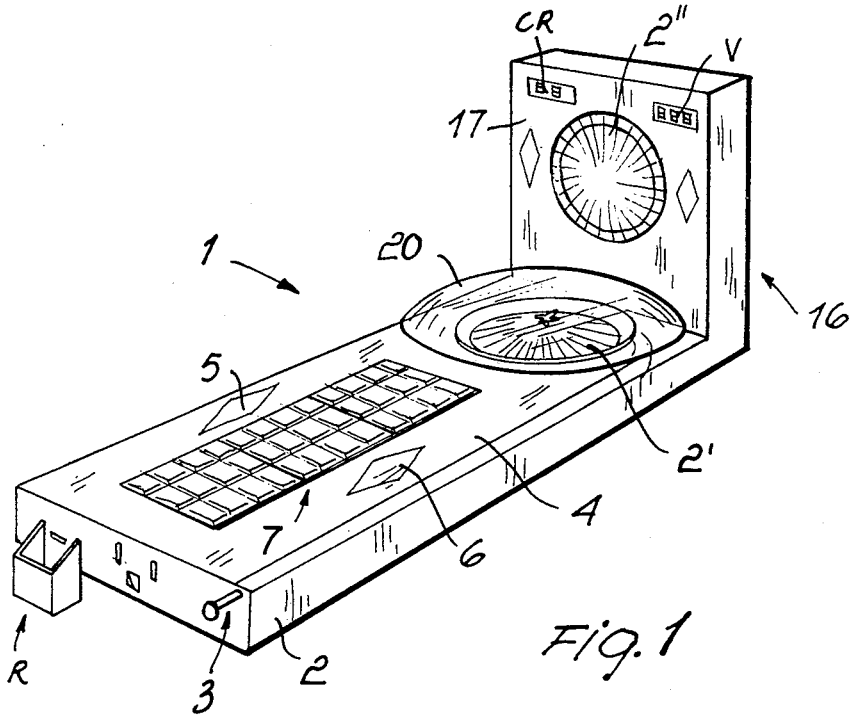
FIG. 1 illustrates a perspective view of the electronic roulette according to the invention.

With reference to the mentioned drawings and, more specifically to FIG. 1, is herein illustrated by a perspective view the electronic roulette according to the present invention.

More precisely, the roulette 1 comprises a box-like body of substantially parallelepipedal configuration analogous to the body or casing of a conventional flipper, and indicated at 2, therein there is housed a conventional roulette wheel 2', including the conventional numbered sectors.

Figure 4:
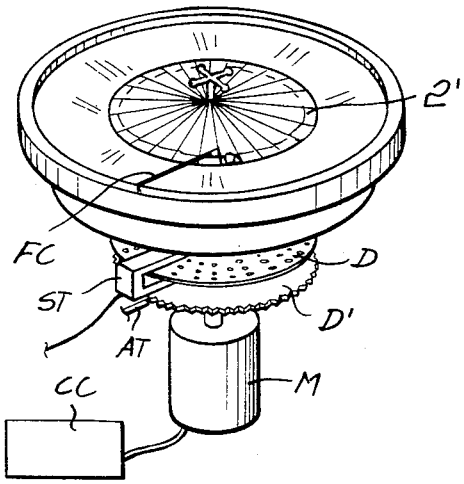
FIG. 4 is a perspective view of a portion of the electronic roulette according to the present invention including the optical coding system for detecting the position of the ball on the roulette wheel which is a main aspect of the preferred embodiment of the subject electronic roulette.

In order to cause the roulette wheel 2' to rotate there is provided an electric motor, indicated schematically by M in FIG. 4, which is operatively coupled to the shaft of the wheel itself and is effective to drive it with a first constant speed.

In this embodiment of the present invention it is provided that the roulette wheel 2' is always driven with a rotary movement and that the speed of the latter is increased as the ball is launched, to resume the original speed as the ball stops in a numbered sector of the wheel 2'.

To launch the ball P, there are provided conventional launching means, indicated generally at 3, which may be completely analogous to the conventional launching means for launching a flipper ball, consisting, as it is well known, of a spring biased plunger provided with an actuating knob.

According to the present invention, the ball is launched through a tube. At the ends whereof there are arranged microswitches, not specifically shown, for controlling or driving the start of the logical functions and for signalling to the controlling logic as the ball enters the roulette wheel.

In FIG. 1 the launching means 3 have been shown in the usual position at the top right corner of the box-like body 2.

The latter, in particular, is closed at the top by a transparent cover member 4, for example made of glass or plexiglass, thereon there are defined the colored patterns, for example the two shown diamond patterns 5 and 6, effective to define the playing fields of red and black of the roulette 1.

Associated in a substantially tight relationship with the cover 4 there is provided a keyboard 7, defining a substantially rectangular key matrix, including a plurality of push-buttons effective to define, as they are pressed by the player, the possible playing combinations.

It should be apparent that the number of the mentioned possible playing combinations will affect the number of the keys:from the studies by the inventor it has been found that, in order to have a rather faithful reproduction of the playing combinations, analogous to those of a real roulette, with the possibility of excluding desired combinations, the optimal key number for the keyboard 7 should vary from 64 and 128.

To that end it should also be pointed out that the subject keyboard may be completely analogous to a conventional keyboard, with the numbers arranged as on a conventional roulette field, or it may carry, in addition to the number identifying keys or push-buttons, specific patterns or marks effective to define the desired combinations, such as doublets (the so called horse combinations), tercets or three number arrays and quartets or four number combinations; obviously the precise keyboard structure will depend on the specific desired design for the machine.

Figure 2:
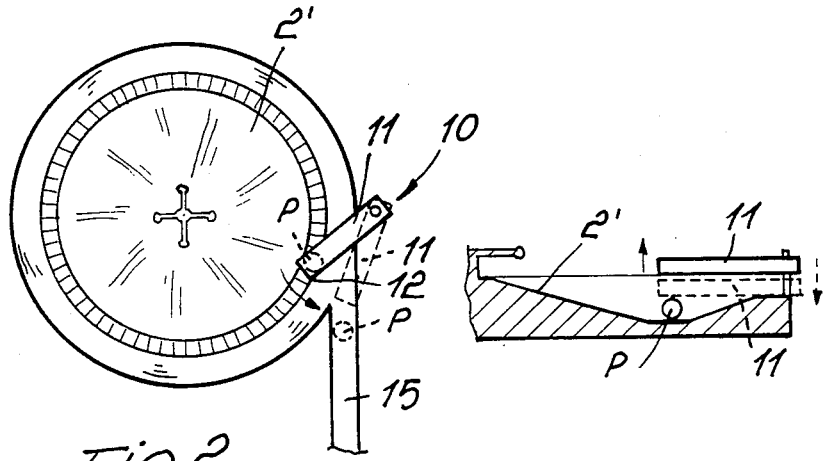
FIG. 2 illustrates the detail of the ball recovering arm associated with the electronic roulette according to the invention.

In order to recover the ball P to afford the player with the possibility of playing again, there has been provided a recovering assembly located near the roulette wheel 2' and indicated overally by the reference number 10 (FIG. 2).

More specifically the recovering assembly 10 comprises a small arm 11 provided for swinging movement through a cam assembly not specifically shown, since it comes within the experience of those skilled in the art: in particular the swinging stroke of the arm will be restrained at two, end of stroke, positions, which will be detected and signalled to the logic for example by means of respective microswitches, not specifically shown.

In the constructed embodiment, the arm moves substantially vertically between a substantially spaced position from the wheel 2' and a position thereat. The free end 12 of the arm 11 is substantially near to the wheel 2' itself.

For recovering the ball P, the arm 11 may be provided, at its free end 12, with ball engaging means which for example (in the case of a metal material ball) may consist of an electromagnet, controlled by the microprocessor, or of a sucking cup (in the case of a plastics material ball).

To that connection it should be noted that the software controlled driving circuitry will cause the arm 11 to descent on the ball in a stable or stopped condition on a numbered sector, the ball being brought under the arm, after stopping, due to the mentioned constant rotary movement of the roulette wheel 2'.

In the constructed embodiment a second electric motor has been provided for driving the ball recovering arm.

Thus, it has been possible to make independent from one another the rotary movement of the roulette wheel 2' and the swinging movement of the ball recovering arm, with a consequent increase of the reliability of the machine operation and a complete elimination of possible errors.

After engaging, the ball P will be discharged into the discharging and recovering channel 15, through a suitable controlled disenergizing of the arm 11 swinging means and, finally, the arm will be brought to its starting rest position.

With continuous reference to FIG. 1, it should be noted that with the box-like body 2 there is associated a front top member 16, also made with a box-like shape, which is closed at the front by a transparent material cover 17 illuminated by the inside by suitable illuminating means, not shown, and thereon there are defined display regions such as, respectively, a reproduction 2'' of the roulette wheel 2' and at least two regions CR, V defining a display of the player "credit"(that is of the available introduced tokens) as well as of the partial or total wins.

The mentioned colored regions will be of course specifically designed both in number and in shape, depending on the envisaged application.

More specifically in the front portion 16 of the box-like body 2 acoustic signalling devices may be inserted effective to signal to the player the wins, which will be directly observed both by visually controlling the ball movement on the roulette wheel 2'(through the transparent bowl 20 associated with the box-like body 2) and by observing the patterned roulette as reproduced on the front 16 and indicated by 2''.

To that connection, and in order to facilitate the designing of the machine controlling software, it should be apparent that win maxima may be provided, with reference to each combination, for example a maximum of 999 counters for a so-called "EN-PLEIN".

Figure 3:
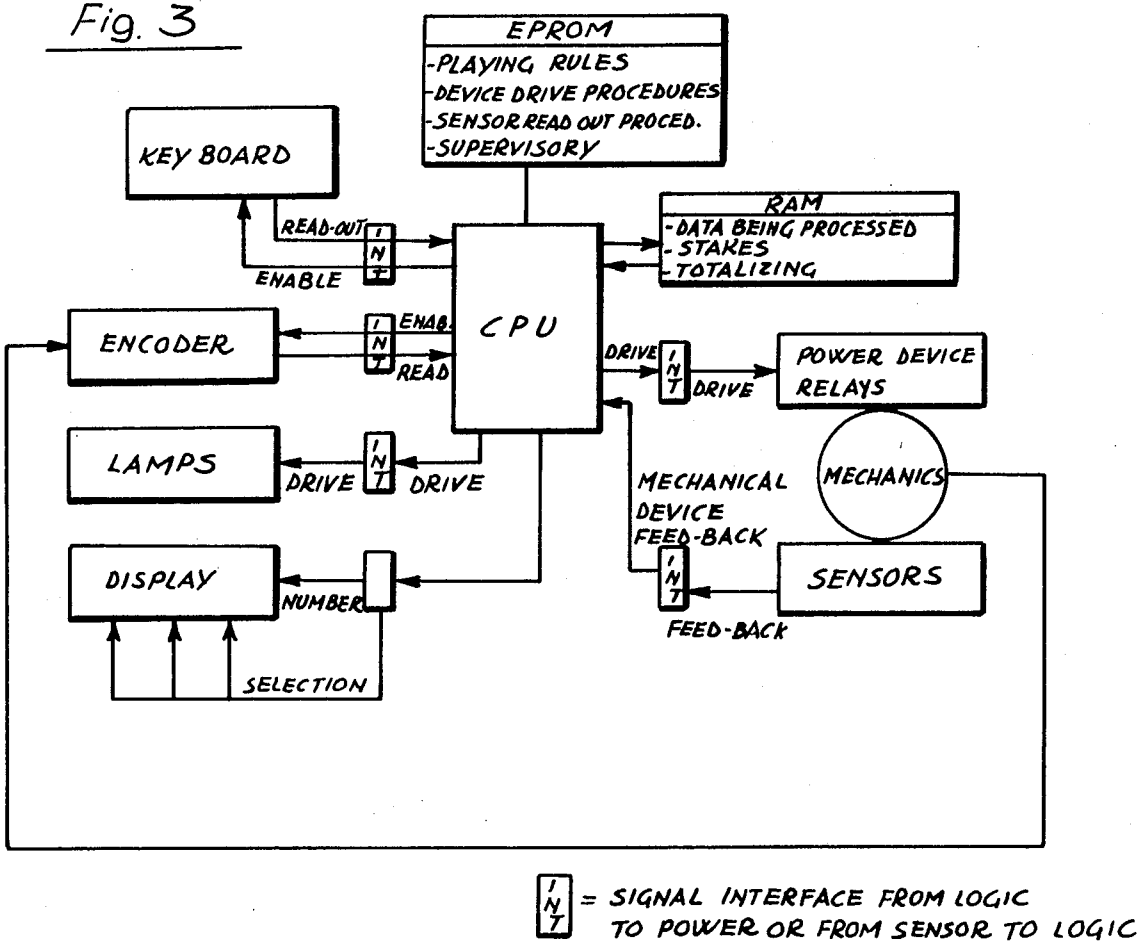
FIG. 3 illustrates a block diagram of the central processing unit associated with the electronic roulette according to a preferred embodiment of the present invention.

Making now reference to FIG. 3, a block diagram is herein illustrated of the central processing and controlling unit (which may include any known types of microprocessors) associated with the electronic roulette according to the invention, and which will not be disclosed herein in any further details since it comes within the experience of those skilled in the art, jointly to the unpatentable software controlling it.

Figure 5:
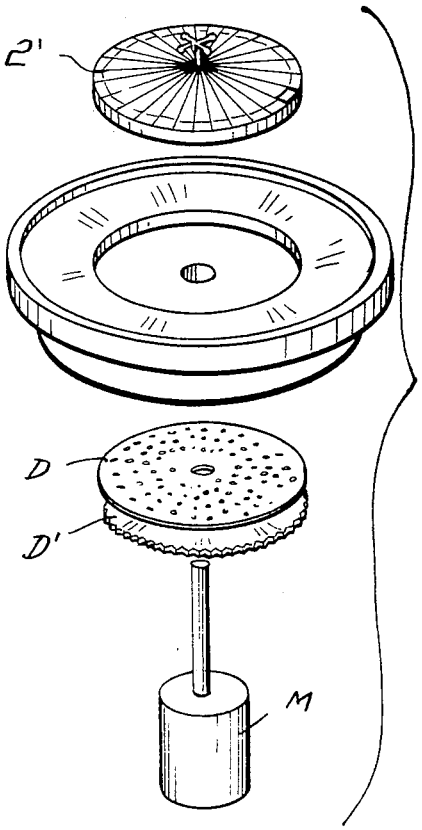
FIG. 5 is an exploded perspective view of the assembly illustrated in FIG. 4.
Figure 6:
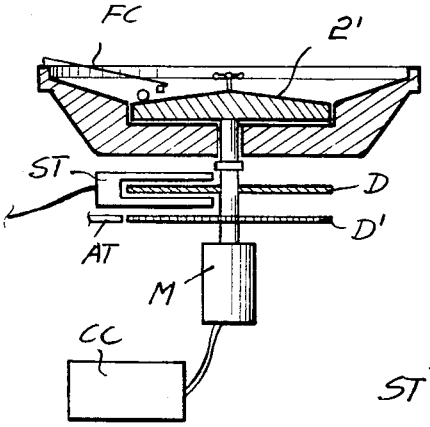
FIG. 6 is a partially sectioned view of the assembly illustrated in FIG. 4.

With reference now to FIG. 4 and the perspective exploded view of FIG. 5, the ball sensing device associated to the electronic roulette of the present invention and forming a main part whereof, substantially comprises a perforated disc, indicated by the reference letter D, which is provided with a plurality of holes, for example radially arranged, each hole combination on a ray or radial line representing, such as in binary code, the overlying number (that is the number represented on the roulette wheel top surface) corresponding to a specific sector of the roulette wheel. The mutual arrangement of the sensing device and roulette wheel should be apparent from the drawing.

Under the perforated disc D there is arranged a further toothed disc D', therewith may engage a stop tooth AT provided for locking the toothed disc D' and accordingly the perforated coded disc D rigid therewith.

Figure 7:
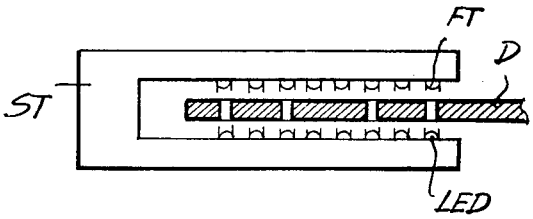
FIG. 7 is a shematic diagram illustrating a detail of the optical system associated with the subject encoder for sensing or detecting the position of the ball at a rest condition on one of the numbered sectors or patterns of the electronic roulette according to the present invention.

Radially encompassing the perforated disc D, above and under the latter, there is provided a bracket member ST, illustrated in a more detailed way in FIG. 7, which comprises, from one side, for example the lower one, a plurality of light emitting diodes of LED's and, on the other side, a corresponding plurality of phototransistors FT.

To codify the 36 numbers of a roulette, in addition to the zero, there have been used, in the preferred embodiment, eight light-emitting diode-phototransistor pairs, whereof a pair represents, in known way, a parity pair.

The optical encoder assembly, for sensing or detecting the ball position on the roulette wheel 2', further comprises a photocell FC, located on the top of the roulette casing or body near the numbered sectors whereof.

The operation of the disclosed optical sensing device which, as aforesaid, is a main feature of the roulette according to the present invention is as follows:after having launched the ball P, and as it has been stopped in one of the numbered sectors, the control circuitry, schematically indicated by the block CC will cause the electric motor M to rotate in order to bring the two discs D,D' to a read-out point by the light emitting diodes and phototransistors which, as it should be apparent, directly lies under the photocell CF.

More specifically, the central processing unit will operate the electric motor M as far as the ball P, not shown in FIG. 4 and in a rest condition in a numbered sector or casing, is brought near the photocell or in front of the latter.

At this time, the photocell will detect the presence of the ball and will inform the central processing unit which, simultaneously, will cause the stop tooth to snap into a recess of the toothed disc D' to lock the latter and the perforated disc D rigid therewith; thus an optical read out may be carried out by the light emitting diode-phototransistor assembly depending on the traversing of light rays through the holes of the mentioned perforated encoding disc D.

The disclosed optical detecting or sensing device has been found to be of great accuracy, independently from the environmental illumination conditions.

Making now reference to FIG. 3, the operation of the electronic roulette according to the invention will be disclosed with respect to the logic control point of view.

In particular the subject system is controlled, as aforesaid, by a processing unit CP, for example of the 6502 type, completely interface as a single matrix, with a subdivision in single functions through at least a VIA (for example of the 6522 type) and at least a PIA (for example of the 6520 type).

The play is started by introducing a desired number of tokens or coins into a receiving hopper (not specifically shown and of known type), which number will be automatically displayed for example on the display CR.

Preliminary to this, the dedicated software will control the overall system and verify that the mechanical components and ball are in the proper set conditions.

By pressing the keyboard programming end push button or key (not specifically shown) the ball will be disengaged from its rest position (for example within the launching tube) and brought at one end of the launching plunger (not shown). It will be launched by the player who may have, if desired, the possibility of adjusting, within a determined maximum period of time, the stopping of the ball as well as the two provided speeds, under the control of the dedicated software.

This possibility is a very important one, since it will afford the possibility of easily obtaining a license for the Roulette for fair use, since, with the mentioned possibility of stopping the ball and adjusting the motor speeds, the roulette will become an ability game. On the other hand, by excluding that possibility, the roulette will be suitable for casinos, thereby meeting with the rules of the enforced laws.

At this time the ball will be brought under or near the photocell FC, in the disclosed manner, and the optical encoder, aligned with the photocell, will transmit to the processing unit the number of the roulette wheel casing or sector in which the ball is located, for example in binary code.

After having compared this value with the value set by this player on the keyboard and stored in the RAM and displayed on the front panel associated with the roulette, the possible win will be signalled, for example by an intermittent light or/and a music.

Then the central processing unit will pay the win, by tokens or coins, supplied from a supplying hopper not specifically shown and suitably located in the box-like body of the roulette.

Then the central processing unit will provide a command for recovering the ball, which recovery will be carried out by the above illustrated recovering arm.

If the recovery operation is not completed within three times, then the central processing unit will signal it through the payment display, by means with suitable marks. For example, if the ball is not reintroduced into the launching tube, then the central processing unit will search for it through the roulette wheel. As the ball is found, the CPU will command the recovery arm to recover it and, if necessary, will repeat that operation until success.

In particular the software is so designed that, as the apparatus is started, the position of the ball will be automatically controlled and, in the case of a lack, the play will be not enabled.

Of course, the interface PIA-VIA will be made through power relays, in order to prevent signal backflows from occurring.

As indicated, the greater speed of the roulette wheel will be actuated by a sensor, for example a microswitch, located at the top end of the launching tube.

From the above disclosure it should be apparent that the invention fully achieves the intended objects.

While the invention has been disclosed and illustrated with reference to a preferred embodiment whereof, it should be noted that it is susceptible to several modifications and variations, all of which come within the scope of the invention. For example while an optical encoder has been disclosed for sensing the position of the ball on the roulette wheel, it should be apparent that said optical encoder may be replaced by any other suitable sensor, such as transducers of absolute, analogic, digital, incremental, Hall effect types as well as electromagnetic transducers. Finally the perforated disc D may be keyed on the driving shaft through a magnetic clutch, to be idle as the roulette wheel rotates with the small speed.

I claim:

1. A microprocessor controlled roulette game comprising in combination, in a box-like body, a roulette wheel, a first electric motor operatively coupled to said roulette wheel to drive it with at least a first constant set speed, launching means to be operated by the player to launch a ball onto said roulette wheel, playing selecting means effective to be actuated by the player in order to define a stake value, position sensing means, for sensing the position of said ball on said roulette wheel, when said ball is in a rest condition, means for introducing tokens in order to set said stake value, token supplying means for supplying a predetermined number of said tokens in the case of a win by said player, a microprocessor circuit operatively coupled to and controlling said motor, said launching means, said playing selecting means, said position sensing means, and said token supplying means in such a way that, in the case of a win, said token supplying means are caused to supply said predetermined number of said token, means for recovering said ball as said ball is in a rest condition in a case defining a number on said roulette wheel, means for recovering said ball sent to said launching means, said ball recovering means consisting of a swinging arm effective to axially move in a substantially vertical direction for predetermined stroke lengths, as driven by a second electric motor, said first and second electric motors' speed being directly controlled by said player, said arm radially extending with respect to said roulette wheel and having a free end provided with means for engaging said ball and retaining it in a ready condition to be discharged, upon command, into a recovery channel, said ball position sensing means consisting of an optical encoder comprising a perforated disc member, having a plurality of spaced radially extending holes, each hole line being indicative, in a binary code, of a predetermined number from 0 to 36, each said number of said line corresponding to the number of a numbered case or sector of said roulette wheel, said perforated disc being rigid with said roulette wheel driving shaft, said optical encoder further comprising a light emitting diode-phototransistor array effective to read each radially extending hole combination of said perforated disk, a further toothed disc member being provided associated with said driving shaft and cooperating with a stop tooth member for stopping in a predetermined position said perforated disc, said predetermined position substantially corresponding to the position of said light emitting diode-phototransistor array, photocell means associated with the top of the roulette wheel casing and substantially aligned with said light emitting diode-phototransistor array in order to detect the position of said ball on said roulette wheel case.

* * * * *